United States Patent [19]

Ramacciotti

[11] 4,036,278

[45] July 19, 1977

[54] PROCESS FOR THE PRODUCTION OF LARGE STEEL INGOTS

[75] Inventor: Aldo Ramacciotti, Rome, Italy

[73] Assignee: Centro Sperimentale Metallurgico S.p.A., Rome, Italy

[21] Appl. No.: 630,765

[22] Filed: Nov. 11, 1975

[30] Foreign Application Priority Data

Nov. 11, 1974 Italy ..... 53975/74

[51] Int. Cl.[2] ..... B22D 27/02; B22D 27/06

[52] U.S. Cl. ..... 164/52; 164/DIG. 6

[58] Field of Search ..... 164/52, 94, 95, 96, 164/122, 123, DIG. 6; 75/10 R, 10 C

[56] References Cited

U.S. PATENT DOCUMENTS

| | | | |
|---|---|---|---|
| 1,119,088 | 12/1914 | McKenna | 164/94 |
| 2,056,673 | 10/1936 | Howard | 164/95 |
| 2,893,085 | 7/1959 | Johansson et al. | 164/52 |
| 3,786,853 | 1/1974 | Cooper | 164/52 |
| 3,807,485 | 4/1974 | Paton et al. | 164/95 X |
| 3,875,990 | 4/1975 | Cooper | 164/52 |
| 3,905,803 | 9/1975 | Bianchi et al. | 164/52 X |
| 3,916,978 | 11/1975 | Plockinger et al. | 164/52 |

FOREIGN PATENT DOCUMENTS

| | | | |
|---|---|---|---|
| 47-25967 | 7/1963 | Japan | 164/52 |

*Primary Examiner*—Ronald J. Shore
*Attorney, Agent, or Firm*—Young & Thompson

[57] ABSTRACT

Large steel ingots are produced without pipe and blowholes and with minimum segregation, by teeming the steel into an ingot mold having a hot top that tapers upwardly and whose open upper end is largely filled by an electrode that is spaced from the steel by an electrically conductive slag. During a first stage, current is passed from the electrode through the slag to the steel at a rate to keep the slag and the steel in the upper end of the mold molten. During a second stage, the current is increased and the electrode consumed to restore the liquid level that has fallen due to contraction upon solidification, the electrode having a lower content in segregating elements than the steel. During a third stage, the current and the metal addition are reduced until the ingot is completely solidified.

8 Claims, 1 Drawing Figure

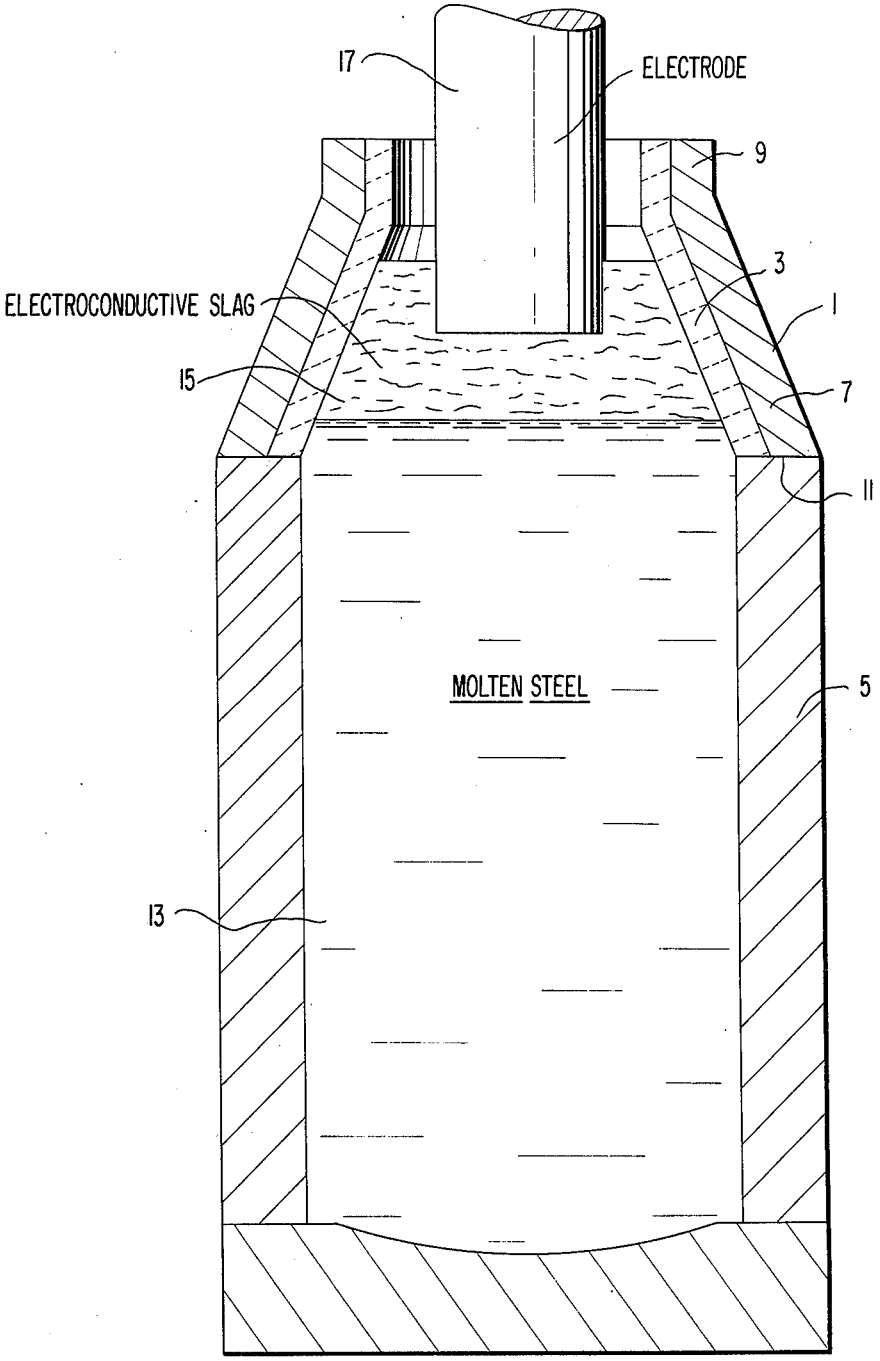
17
ELECTRODE
9
3
ELECTROCONDUCTIVE SLAG
1
15
7
11
MOLTEN STEEL
5
13

PROCESS FOR THE PRODUCTION OF LARGE STEEL INGOTS

The present invention relates to a process for the production of large steel ingots, and more particularly to an improved method for adding further liquid metal to that already present in the ingot mold so as to avoid the formation of pipe and blowholes and to minimize segregation.

For a number of uses very large ingots are necessary, weighing, for instance, 150 to 200 tons and more. However, the normal technique for pouring molten steel into the ingot mold, followed by natural cooling, is not satisfactory for the production of large ingots. This is because shrinkage and thus pipe formation increase with the time required for complete solidification of such ingots — 20 hours or more — with the result that part of the ingot has to be cropped as scrap. Other very serious drawbacks are segregation of certain elements such as carbon, nickel, chromium and silicon, possible oxidation of the metal bath, or absorption of hydrogen by the metal bath, which are also aggravated by the long solidification times, all leading to high percentages of scrap to be cropped and to the production of steels without the desired mechanical properties and uniformity of composition.

Many solutions have been used for eliminating these drawbacks. For instance, insulating and/or exothermic hot tops are used together with exothermic powders to be placed over the surface of the metal bath in the hot tops. Although this solution may eliminate or in some way reduce the pipe formation, it does not prevent segregation or oxidation of the metal bath, or hydrogen absorption.

Also, in addition to the above method, pouring in a protective atmosphere is used. However, apart from the additional cost involved in providing vacuum tanks large enough to contain the ingot molds, and the associated space problems, even this does not solve the problem of segregation.

Another known solution consists in two-stage teeming. An initial amount of steel is teemed and left to partly solidify. A soon as any appreciable segregation starts to occur, the rest of the steel is teemed, the composition of this second steel being such as to balance the segregation.

Although on the one hand this procedure prevents segregation, at least partly, it provides no solution to bath oxidation and the formation of shrinkage cavities. Furthermore, it raises problems regarding the need to have available liquid steels of a very precise composition, at a given moment of solidification which differs from ingot to ingot. Steelmen know just how difficult it is to meet both these conditions at once and at the same time. Then there is the fact that the need for two-stage teeming results in the casting pit being occupied for an excessively long time with consequent slowdown of production.

It is also known that large ingots can be formed entirely by electroslag remelting (ESR). This enables piping and segregation to be eliminated, but there is the drawback that it favors hydrogen absorption by the whole ingot. Moreover this is a costly process and can therefore be used only for very high quality steels.

A recent U.S. Pat. No. 3,786,853 teaches the addition of molten metal while the ingot is in the course of solidification, by melting a metal bar, through ESR or plasma arc or by utilizing a series of electron guns (electron-beam technique), at a controlled rate that broadly corresponds to the volume decrease of the steel in the ingot mold as a result of shrinkage, thus maintaining in the mold the level of the liquid steel constant until solidification is complete. Throughout the process, the molten metal added has the same composition as the metal previously poured into the mold, and the ingot mold has no hot topping.

Although this process may give appreciably better results than those obtainable by previous methods, it is not entirely satisfactory. The sources of heat and molten metal must necessarily have large dimensions in view of the size of the ingot to be produced. The solidification front of the metal in the mold may be considerably disturbed, to the detriment of the final quality of the ingot.

In this case, too, there is still the problem of hydrogen absorption and of segregation. In addition, as is disclosed in that patent, in the part of the ingot mold which contains the liquid slag and which is cooled by water or by an inserted water-cooled metal wall, there is always the risk of inducing the formation of "bridges" of solidified metal which trap zones of liquid metal that, on solidification, leave just those cavities which it was wished to avoid. This process also provides for some vacuum treatments which considerably increase the cost and complexity of the equipment and the process itself.

The object of the present invention is to obviate these drawbacks by providing a simple, inexpensive, improved process which permits the production of large steel ingots without defects and shrinkage cavities, with little segregation and a low absorbed hydrogen content.

According to the present invention, a layer of electrically conductive molten slag whose horizontal transverse section is less than that of the internal horizontal section of the upper part of the ingot mold is placed over the molten metal in the mold and contained in a suitable hot top. During the initial phase of the process, after the mold has been filled, said layer of slag and the part of the metal bath beneath the slag and contained in the hot top are kept in the molten state by providing heat through a heating electrode immersed in said slag, without there being any significant addition of liquid metal. In this first phase, the level of the liquid metal is allowed to fall freely following the solidification shrinkage. When the level of the molten metal falls too far or when substantial segregation begins to occur, the second phase of the process starts. This involves a continued supply of heat through the electrode, plug the introduction of new molten steel so as to compensate for the shrinkage and to slowly restore the original level. The new steel has a content of segregating elements which decreases progressively with the solidification of the ingot, so as to minimize the build-up of segregating elements, e.g. C, Ni, Cr and Si, in the upper part thereof.

A third phase may also be provided during which, when the ingot is almost completely solidified, the heat input is gradually reduced as the addition of new metal is simultaneously reduced to nil, so as to improve the solidification of the ingot.

The present invention will now be described in greater detail by reference to a preferred embodiment, which will be taken in connection with the accompanying drawing, which is a cross-sectional view of an ingot mold with hot top and electrode for the practice of a process in accordance with the present invention.

This is provided purely for the purpose of exemplification and not for limitation.

According to the present invention a metal hot top 1 lined with suitable refractory material 3 is placed upon the top of a normal ingot mold 5. The internal profile of the hot top is gradually tapered upwardly in its first section 7 starting from its joint 11 with the top of the mold, whereas the walls of its upper part 9 are parallel. If the cross-section of the ingot mold is practically round, its three-dimensional form may be that of a hyperboloid of revolution.

The area of the internal horizontal section of that upper part 9 of the hot top 1 is between 25 and 50% of the area of its section at the joint 11 with the top of the mold.

Steel 13 is poured in this ingot mold-hot top assembly until it fills the hot top almost completely. An electrically conducting slag 15 is then placed over the surface of the steel, the composition of the slag being compatible with the refractory lining of the hot top. An electrode 17, preferably metallic, is immersed in the slag and current is passed from the electrode to the ingot mold, through the slag bath and the liquid steel according to the conventional ESR technique. During the first phase, the sole purpose of the electrode is to supply just the amount of heat, to the slag bath and metal in the hot top, which is needed to strictly balance the heat loss and to keep the slag and metal molten. The electrode may be of the non-consumable type, e.g. of graphite or copper, suitably cooled, but preferably it is the same consumable electrode which will be subsequently melted to supply metal to the metal pool below. It is important to emphasize the fact that no new molten metal is supplied in this first phase; and the amount of current is accordingly suitably limited.

Due to the change from liquid to solid state of a part of the steel enclosed in the mold, the level of metal and slag in the hot top gradually falls. At the same time, the concentration of some of the elements composing the steel will increase in the liquid metal, owing to their lesser solubility in the solid phase that is in the course of forming.

As soon as one of these two phenomena nears a predetermined point, which may be ascertained by methods which are within the skill of the art, e.g. determination of the carbon content of the unsolidified steel or the level of the falling metal, the second stage of the process starts. During this stage not only is the metal bath continuing to be supplied with heat, but also liquid metal is added. This is done preferably by using a consumable electrode and by increasing the power supplied thereto. However, any other method of feeding new liquid metal could obviously be used without departing from the spirit and the scope of the present invention; and specifically, non-consumable electrodes of graphite or copper may be used.

To minimize the harmful effects of segregation, the composition of the new molten steel that is added in this second stage is gradually varied with time, in that it will contain a continuously decreasing percentage of the segregating elements. For this purpose, one preferred technique is to use a consumable electrode formed of a metal casing filled with a metal powder having the required composition that varies with the length of the electrode. Such an electrode is described, for example, in U.S. Pat. Nos. 3,905,803, Sept. 16, 1975, U.S. Pat. No. 3,959,575, May 25, 1976 and 3,975,577, Aug. 17, 1976.

During this stage when new steel is being added, the feed rate is such as to ensure continued compensation of the decrease in volume due to shrinkage and to gradually restore the original level of the steel in the hot top.

When more than 90% of the ingot has solidified, it is possible to start a third stage in which the power supplied to the electrode is gradually decreased and the addition of new steel is tapered off to nil. This third stage will end when all the steel in the mold has solidified.

Of course the process of the present invention can be also performed in a protective atmosphere or under vacuum. However, it will be appreciated that there is a considerable advantage in being able to operate without the costly equipment normally needed to work under vacuum or in a protective atmosphere. Actually, because of the small internal cross section of the hot top, further reduced by the presence of the electrode, the absorption of hydrogen from the atmosphere and oxidation of the bath are considerably diminished, enabling the process to be performed in a normal atmosphere or at least with the introduction of only a small amount of inert gas to the hot top.

The present invention provides many important advantages, such as, for instance:

Reduction in the volume of the hot top, which can even be less than 10% of the total volume of the ingot Complete absence of pipe or other internal cavities Uniform steel composition throughout the length and cross section of the ingot Avoidance of costly vacuum degassing equipment or at least of tying up such equipment for the whole duration of the process up to solidification, since in this case it would be used only in the preliminary stage of teeming.

To enable those skilled in this art to practice the invention, the following illustrative example is given:

For the production of a 100-ton forging ingot of generally circular cross-sectional configuration, an ingot mold is used having a height about 3.5 meters, an inner diameter about 2 meters, and a hot top whose height is about 1.5 meters and whose lower internal diameter is about 2meters and whose upper internal diameter is about 1.1 meters. The hot top is lined with a conventional refractory containing at least 85% by weight $A1_2O_3$.

Steel is teemed into the ingot mold having a composition C: 0.45%, Mn: 0.7%, Si: 0.33%, Ni: 1.8%, Cr: 1.1%, V: 0.07%, all percentages by weight, balance essentially iron. The steel fills the hot top for about 60% of the height of the hot top.

A consumable steel electrode of 80 centimeters in diameter and having a composition C: 0.2%, Mn: 0.7%, Si: 0.20%, Ni: 0.05%, Cr: 0.05%, and Mo: 0.01%, all percentages by weight, balance essentially iron, is inserted in the open upper end of the hot top and an electro-conductive slag containing 70% by weight $CaF_2$ and 30% by weight $A1_2O_3$ is poured over the liquid steel.

With the ingot mold grounded, a current of about 1,000 KVA is passed through the electrode and the slag to maintain at least the slag in a molten state. As the steel solidifies, it shrinks and the liquid level falls, at the same time that the carbon content of the unsolidifed steel increases. When the carbon content reaches about 0.55% by weight, a second stage is commenced in which the current is increased to about 1,500 KVA. At this current level, the electrode is consumed and progressively melts and the level of the molten steel is returned to its original height. During this stage the current is progressively increased to about 2,000 KVA.

When the steel in the ingot mold is at least 90% solidified, the third stage is begun, during which the current is gradually lowered to 1,500 KVA and below; and when all the steel in the ingot mold is solidified, the current is interrupted. The resultant ingot is demolded and shows no solidification cavities or other defects and a very limited segregation.

From a consideration of the foregoing disclosure, therefore, it will be evident that the object of the invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. In a process for the production of a large steel ingot free from defects due to shrinkage cavities and with reduced segregation and low absorbed hydrogen content, comprising teeming a quantity of liquid steel into an ingot mold, establishing a layer of electrically conductivity liquid slag over said steel, immersing an electrode in said slag, and passing an electric current through said electrode and slag and steel to keep said slag molten and to supply heat to the liquid steel in the mold; the improvement comprising, in a first stage, maintaining the electric current through said electrode and slag and steel at a level to supply just the amount of heat to the slag bath and metal in the top of the mold which is needed to maintain the layer of slag and only that part of the metal bath beneath the slag and contained in the top of the mold in a molten state while metal elsewhere in the mold solidifies and the level of the molten metal at the top of the mold decreases due to shrinkage of the metal in the mold upon solidification; and in a second stage increasing the current through the electrode and slag and steel sufficiently to melt a portion of the electrode to restore the original level of the steel in the mold.

2. A process as claimed in claim 1, and in a third stage that follows said second stage, reducing the heat supplied to the mold and the molten metal that is added, until the steel in the mold is completely solidified.

3. A process as claimed in claim 2, in which said third stage begins when more than 90% of the steel in the ingot mold has solidified.

4. A process as claimed in claim 1, in which the diameter of the surface of the molten slag is substantially smaller than the diameter of the surface of the molten steel in the mold.

5. A process as claimed in claim 1, in which said electrode occupies most of the internal area of the upper end of the hot top that surrounds said mold.

6. A process as claimed in claim 1, the composition of at least the melted portion of the electrode being lower in elements that tend to segregate upon solidification of steel than is the unsolidified liquid steel in the mold during said second stage.

7. A process as claimed in claim 1, and feeding that portion of the electrode which melts, downwardly as a metal powder through a metal casing comprising said electrode.

8. A process as claimed in claim 7, in which the composition of said metal powder varies lengthwise of the electrode.

* * * * *